US009287668B2

(12) United States Patent
Chen et al.

(10) Patent No.: US 9,287,668 B2
(45) Date of Patent: Mar. 15, 2016

(54) I/O PLUG CONNECTOR ADAPTED FOR NORMAL INSERTION AND REVERSE INSERTION INTO I/O RECEPTACLE CONNECTOR AND CONNECTOR ASSEMBLY HAVING THE TWO

(71) Applicant: HON HAI PRECISION INDUSTRY CO., LTD., New Taipei (TW)

(72) Inventors: Ming-Ching Chen, New Taipei (TW); Shun-Jung Chuang, New Taipei (TW); Wei-Ta Tseng, New Taipei (TW); Yan-Nan Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 68 days.

(21) Appl. No.: 14/056,977

(22) Filed: Oct. 18, 2013

(65) Prior Publication Data

US 2014/0113487 A1 Apr. 24, 2014

(30) Foreign Application Priority Data

Oct. 18, 2012 (TW) ..... 101138520 A

(51) Int. Cl.

| | |
|---|---|
| ***H01R 13/648*** | (2006.01) |
| ***H01R 24/62*** | (2011.01) |
| ***H01R 13/66*** | (2006.01) |
| *H01R 13/6594* | (2011.01) |
| *H01R 27/00* | (2006.01) |

(52) U.S. Cl.

CPC ..... *H01R 24/62* (2013.01); *H01R 13/6658* (2013.01); *H01R 13/6594* (2013.01); *H01R 27/00* (2013.01)

(58) Field of Classification Search

CPC ..... H01R 4/2466; H01R 12/79; H01R 13/65802; H01R 23/6873; H01R 23/7073

USPC ..... 439/607.01, 607.35, 607.4, 660, 397, 439/493, 353, 357, 358

See application file for complete search history.

(56) References Cited

U.S. PATENT DOCUMENTS

| | | | | |
|---|---|---|---|---|
| 6,139,350 | A * | 10/2000 | Mathesius | 439/357 |
| 6,997,733 | B2 * | 2/2006 | Peng | 439/353 |
| 7,174,465 | B2 * | 2/2007 | Freeman et al. | 713/191 |
| 7,422,465 | B2 * | 9/2008 | Watanabe et al. | 439/353 |

(Continued)

FOREIGN PATENT DOCUMENTS

| | | |
|---|---|---|
| CN | 201440469 | 4/2010 |
| CN | 101877441 | 11/2010 |

(Continued)

*Primary Examiner* — Thanh Tam Le

(74) *Attorney, Agent, or Firm* — Wei Te Chung; Ming Chieh Chang

(57) ABSTRACT

An Input/Output (I/O) plug connector (100) includes an insulative housing (1) having a base portion (11) and a mating portion (12) extending forwardly from the base portion, the mating portion having a top wall (121), a bottom wall (122), a pair of sidewalls (123) cooperatively and peripherally defining a receiving space (125), a number of first contacts (21) retained in the top wall and a number of second contacts (22) retained in the bottom wall, the first contacts and the second contacts facing toward each other across the receiving space along a vertical direction; a circuit plate (4) assembled to the base portion of the insulative housing and sandwiched between the first contacts and the second contacts for electrical connection; and a metal shield (5) covering the insulative housing.

16 Claims, 11 Drawing Sheets

(56) References Cited

U.S. PATENT DOCUMENTS

| | | | | |
|---|---|---|---|---|
| 7,462,071 | B1 * | 12/2008 | Wu | 439/607.05 |
| 7,534,141 | B1 * | 5/2009 | Wu | 439/607.01 |
| 7,618,293 | B2 * | 11/2009 | Wu | 439/660 |
| 7,651,379 | B1 * | 1/2010 | Wu | 439/660 |
| 7,845,965 | B2 * | 12/2010 | Ko | 439/352 |
| 8,066,532 | B2 * | 11/2011 | Hou et al. | 439/660 |
| 8,262,411 | B2 * | 9/2012 | Kondo | 439/607.01 |
| 2013/0115821 | A1 | 5/2013 | Golko et al. | |

FOREIGN PATENT DOCUMENTS

| | | |
|---|---|---|
| CN | 202231235 | 5/2012 |
| TW | M253969 | 12/2004 |
| TW | M349053 | 1/2009 |

* cited by examiner

I/O PLUG CONNECTOR ADAPTED FOR NORMAL INSERTION AND REVERSE INSERTION INTO I/O RECEPTACLE CONNECTOR AND CONNECTOR ASSEMBLY HAVING THE TWO

BACKGROUND OF THE INVENTION

1. Field of the Invention

The present invention relates generally to an Input/Output (I/O) plug connector adapted for normal insertion and reverse insertion into an I/O receptacle connector, and more particularly to a connector assembly having the I/O plug connector and the I/O receptacle connector.

2. Description of Related Arts

Taiwan Patent No. M370848 discloses a USB-type plug connector. The USB-type plug connector comprises a metal shield peripherally defining a receiving space for receiving a mating receptacle connector. The plug connector has a printed circuit board (PCB) assembled in the receiving space of the metal shield for dividing the receiving space into an upper receiving space and a lower receiving space. The printed circuit board has each four circuits on both the upper face and the lower face thereof The upper four circuits and the lower four circuits are electrically connected with each other and therefore, the plug connector is adapted for normal insertion and reverse insertion into the receptacle connector. Because the receptacle connector has a mating tongue alternatively received in one of the upper receiving space and the lower receiving space while the other one of the upper receiving space and the lower receiving space is idle. There is a torsion between the plug connector and the receptacle connector in such mating condition. The torsion induces that electrical connection therebetween may be damaged. Worsely, the mating tongue of the receptacle connector may be warped or cracked.

An improved I/O plug connector adapted for normal insertion and reverse insertion into an I/O receptacle connector, and a connector assembly having the I/O plug connector and the I/O receptacle connector is desired.

SUMMARY OF THE INVENTION

Accordingly, an object of the present invention is to provide an improved Input/Output (I/O) plug connector adapted for normal insertion and reverse insertion into an I/O receptacle connector, and a connector assembly having the I/O plug connector and the I/O receptacle connector.

To achieve the above object, an I/O plug connector includes an insulative housing having a base portion and a mating portion extending forwardly from the base portion, the mating portion having a top wall, a bottom wall, a pair of sidewalls cooperatively and peripherally defining a receiving space, a number of first contacts retained in the top wall and a number of second contacts retained in the bottom wall, the first contacts and the second contacts facing toward each other across the receiving space along a vertical direction; a circuit plate assembled to the base portion of the insulative housing and sandwiched between the first contacts and the second contacts for electrical connection; and a metal shield covering the insulative housing.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-11, a connector assembly 100 of the present invention comprises an Input/Output (I/O) plug connector 100 and an I/O receptacle connector 200. For better description, taken along a mating direction, a first side of the I/O plug connector 100 adjacent to the I/O receptacle connector 200 is defined as a "front" side while a second side distant away from the first side is defined as a "rear" side. Referring to FIGS. 1, 6, 8, and 9, an upper side of a circuit plate 4 of the I/O plug connector 100 when it is normally inserted into the I/O receptacle connector 200 is a frontal side and an opposite, lower side is a back side. The terms "front, rear, upper, and lower" are not meant to be limiting but are descriptive of depiction according to the claims.

Figure 6:
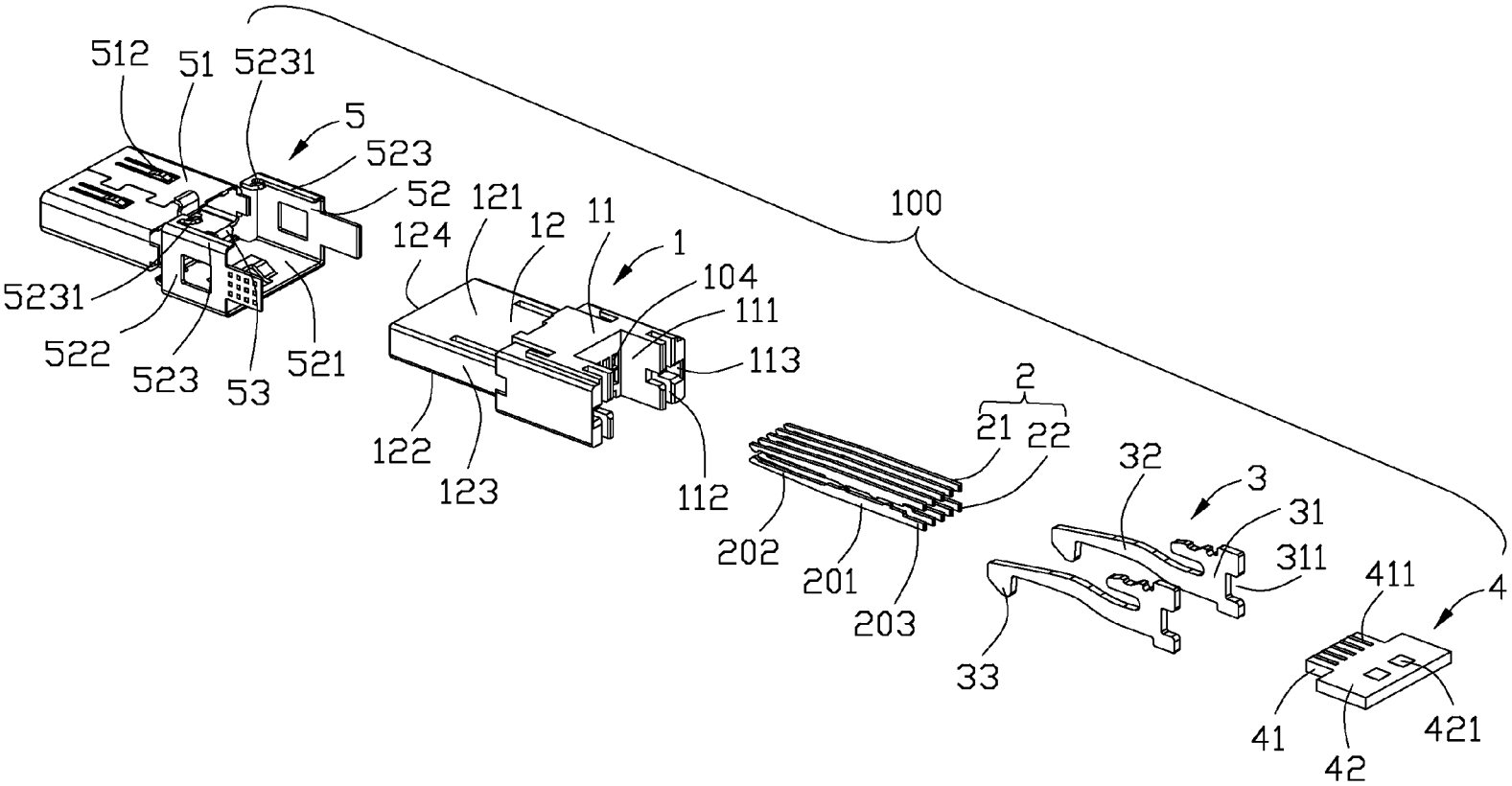
FIG. 6 is a perspective, fully exploded view of the I/O plug connector.

Referring to FIG. 6, the I/O plug connector 100 comprises an insulative housing 1, a plurality of contacts 2 retained in the insulative housing 1, a pair of latches 3 secured in the insulative housing 1 and positioned at two lateral sides of the contacts 2, the circuit plate 4 secured to a rear side of the insulative housing 1 for electrically connection with the contacts 2, and a metal shield 5 covering the insulative housing 1.

Referring to FIGS. 3-6, the insulative housing 1 defines a plurality of passageways 10 receiving the contacts 2. The insulative housing 1 comprises a base portion 11 and a mating portion 12 extending forwardly from the base portion 11. The base portion 11 defines a gap 111 at a rear side thereof and the base portion 11 has a pair of slots 112 beside the gap 111 for receiving the latches 3. The base portion 11 defines a notch 113 perpendicular to the slot 112 and communicating with the gap 111 for securing the circuit plate 4. The mating portion 12 has a top wall 121, a bottom wall 122 opposite to the top wall 121, a pair of sidewalls 123 vertically connecting with the top wall 121 and the bottom wall 122, and a front wall 124 vertically connecting with the top wall 121, the bottom wall 122, and the sidewalls 123. The slots 112 extend from a rear face of the base portion 11 towards but not achieves at the front wall 124 of the mating portion 12. The slots 112 further communicate with exterior on the bottom wall 122. The top wall 121, the bottom wall 122, and the sidewalls 123 cooperatively and peripherally defining a receiving space 125. The receiving space 125 has an insertion opening (not labeled) on the front wall 124. The passageways 10 comprise a number of first passageways 101 on the top wall 121 and a number of second passageways 102 on the bottom wall 122. The first passageways 101 and the second passageways 102 face towards each other across the receiving space 125. Each of the first passageways 101 and the second passageways 102 comprises a front recess 103 communicating with the receiving space 1025 and a rear recess 104 extending backwardly through the base portion 11 and communicating with the gap 111.

Figure 4:
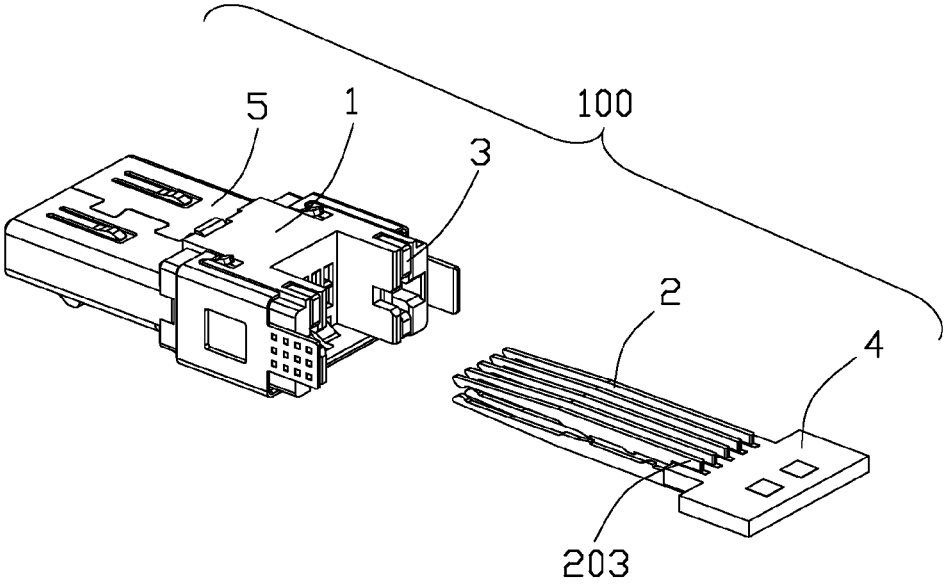
FIG. 4 is a perspective, exploded view of the of the I/O plug connector in which a plurality of contacts and a circuit plate on which the contacts are retained are seperated from an insulative housing.
Figure 5:
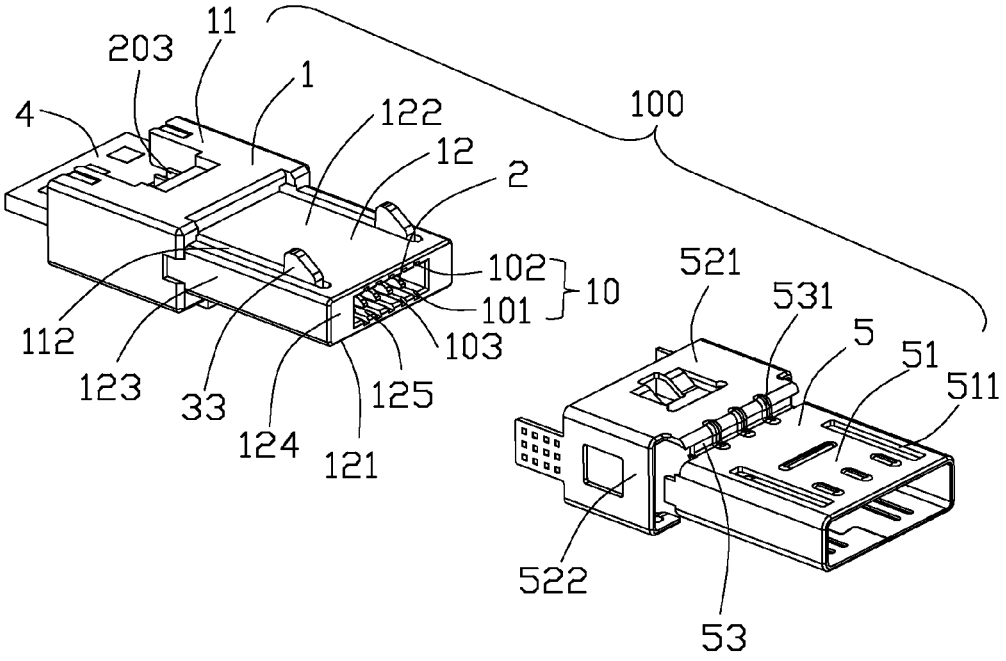
FIG. 5 is a perspective, exploded view of the of the I/O plug connector in which a metal shield is seperated from the insulative housing.

Referring to FIGS. 4-6, the contacts 2 comprises a number of first contacts 21 retained in the first passageways 101 and a number of second contacts 22 retained in the second passageways 102. The contacts 2 are faces towards each other across the receiving space 125. Each contact 2 has a retaining portion 201, a contacting portion 202 extending forwardly from the retaining portion 201, and a rear portion 203 extending backwardly from the retaining portion 201. The retaining portions 201 are retained in the rear recesses 104, the contacting portions 202 are received in the front recesses 103 and extending into the receiving space 125, and the rear portions 203 are positioned in the gap 111 for sandwiching and connecting with the circuit plate 4.

Figure 2:
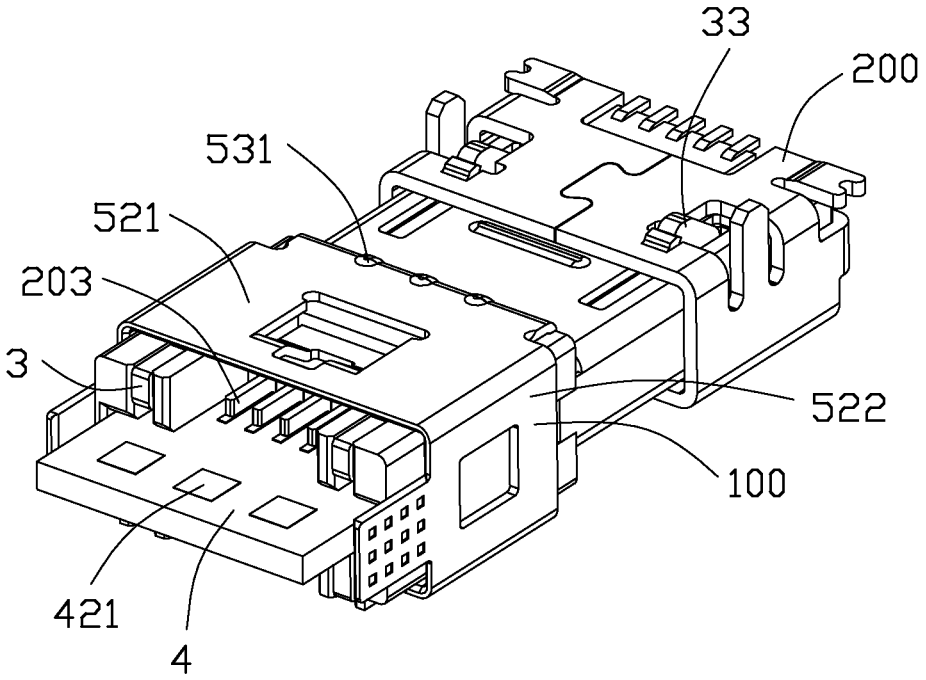
FIG. 2 is a perspective, assembled view of the connector assembly when the I/O plug connector is normally inserted into the I/O receptacle connector.

Referring to FIGS. 2, 5, and 6, each latch 3 is stamped from metal material. Each latch 3 is received in the slot 112 and comprises a fixing portion 31, a flexible portion 32 extending forwardly from the fixing portion 31, and a hook portion 33 formed at the front end of the flexible portion 32. The hook portion 33 extends beyond the bottom wall 122 from the slot 112. The hook portions 33 of the latches 3 are used for engaging with corresponding parts of the I/O receptacle connector 200. Each latch 3 has a cutout 311 and the circuit plate 4 extends into the cutout 311. Therefore, the latches 3 sandwich the circuit plate 4 firmly in the cutout 311.

Referring to FIGS. 6-10, the circuit plate 4 is a printed circuit board in a preferred embodiment, but it is not limiting. The circuit plate 4 comprises a mating tongue 41 for connecting with the contacts 2 and a extension portion 42 integral with the mating tongue 41 for connecting with wires of a cable (not shown). The extension portion 42 has a width larger than that of the mating tongue 41. The circuit board 4 is secured in the notches 113 of the insulative housing 1 and the cutouts 311 of the latches 3.

Referring to FIGS. 7-11, the mating tongue 41 has a plurality of upper circuits 411 on an upper surface of and a plurality of lower circuits 412 on a lower surface of The upper circuits 411 are electrically connected with the rear portions 203 of the first contacts 21. The lower circuits 412 are electrically connected with the rear portions 203 of the second contacts 22. The extension portion 42 has a plurality of soldering pads 421 on an upper surface and a lower surface thereof The soldering pads 421 are connected to the upper circuits 411 and corresponding lower circuits 412 via a plurality of circuit traces 401 and corresponding electrical nodes 43.

Referring to FIGS. 7-11, according to a preferred embodiment of the present invention, the I/O plug connector 100 has five first contacts 21 and five second contacts 22. Therefore, the upper circuits 411 are five and the lower circuits 412 are five, too. Taken along a top plan view of FIG. 8 as FIG. 9, the upper circuits 411 are sequentially labeled as A, B, C, D, and E from a left-to-right direction and taken along a bottom plan view of FIG. 8 as FIG. 10, the lower circuits 412 are sequentially labeled as A', B', C', D', and E' from a left-to-right direction, too. By electrical connection of the circuit traces 401 and the electrical nodes 43, the first upper circuit A is electrical connected with the first lower circuit A', the second upper circuit B is electrical connected with the second lower circuit B', the third upper circuit C is electrical connected with the third lower circuit C', the fourth upper circuit D is electrical connected with the fourth lower circuit D', and the fifth upper circuit E is electrical connected with the fifth lower circuit E'. Therefore, both when the I/O plug connector 100 is normally inserted into the I/O receptacle connector 200 and the I/O plug connector 100 is reversely inserted into the I/O receptacle connector 200, contacts (not shown) of the I/O receptacle connector 200 are correctly and electrically connected with the contacts 2 of the I/O plug connector 100.

Figure 9:
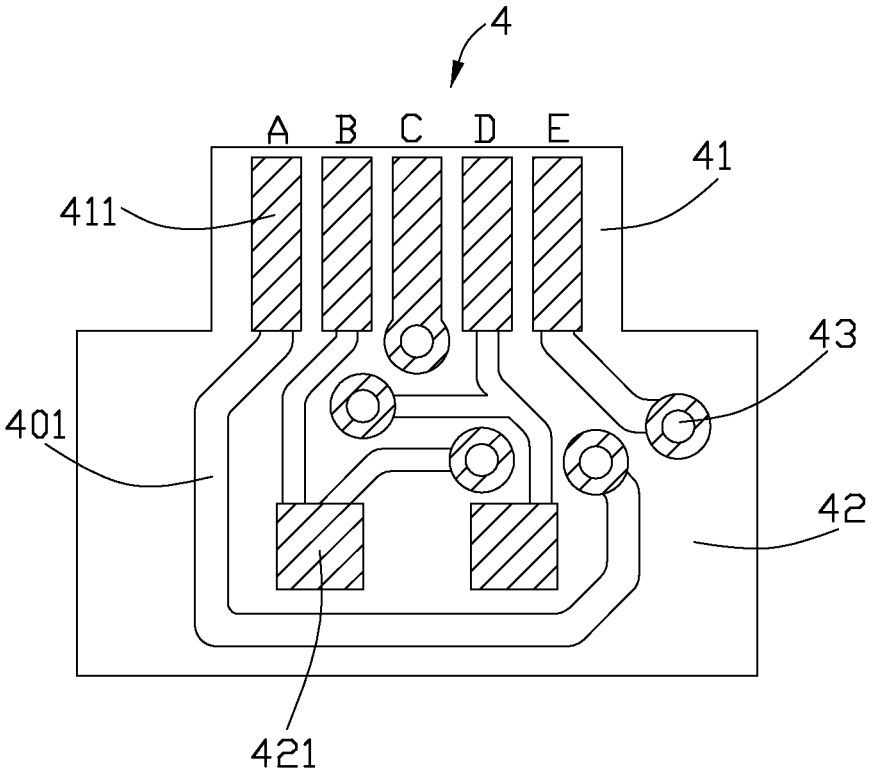
FIG. 9 is a top plan view of the circuit plate of the I/O plug connector, showing the circuits on a first, frontal side of the circuit plate.
Figure 10:
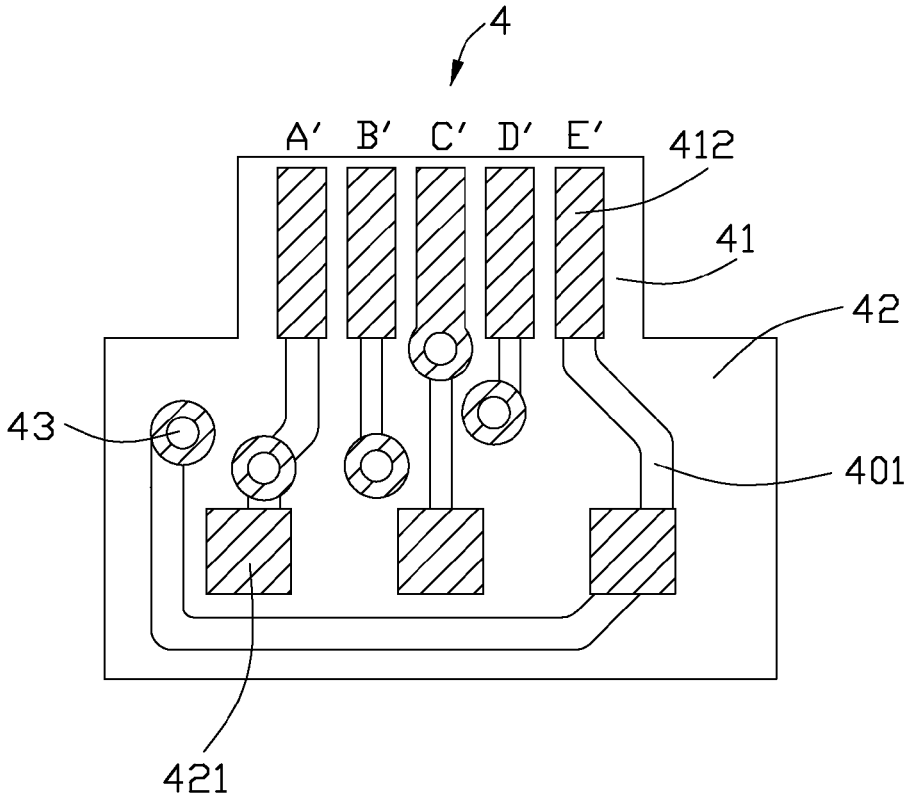
FIG. 10 is a bottom plan view of the circuit plate of the I/O plug connector, showing the circuits on an opposite, second, back side of the circuit plate.
Figure 11:
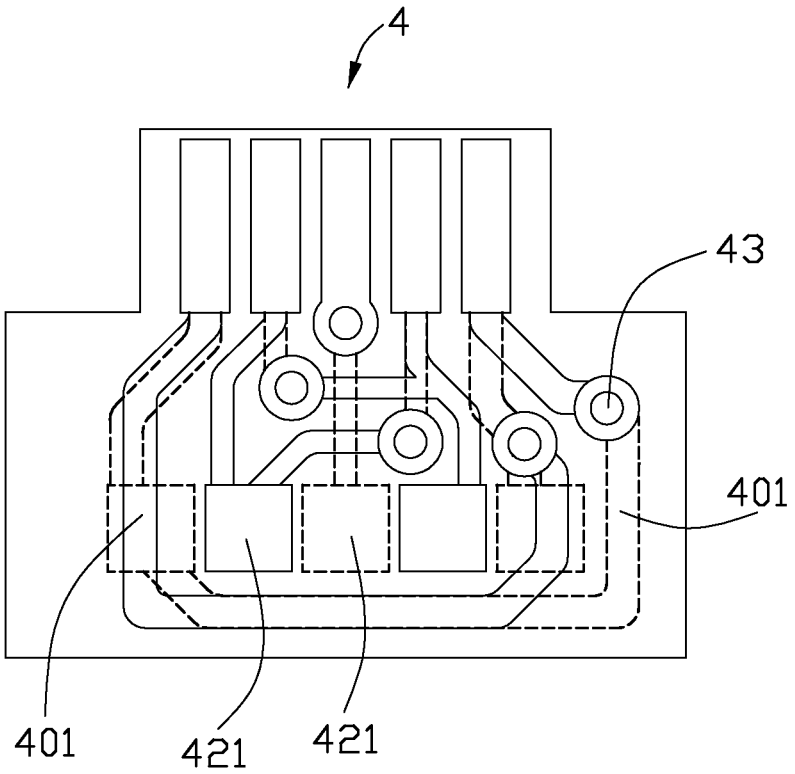
FIG. 11 is another top plan view of the circuit plate, showing how the circuits on the first, frontal side and the circuits on the opposite, second, back side are connected.

Referring to FIGS. 9-11, the soldering pads 421 on the upper surface of the extension portion 42 are two and the soldering pads 421 on the lower surface 42 are three. Referring to FIG. 11, the soldering pads 421 on the upper surface and the soldering pads 421 on the lower surface are alternatively positioned when taken along a vertical direction. The two soldering pads 421 on the upper surface are respectively, correspondingly, and electrically connected with the second upper circuit B, the second lower circuit B', the fourth upper circuit D, and the fourth lower circuit D'. The three soldering pads 421 on the lower surface are respectively, correspondingly, and electrically connected with the first upper circuit A, the first lower circuit A', the third upper circuit C, the third lower circuit C', the fifth upper circuit E, and the fifth lower circuit E'. The circuit traces 401 comprises a plurality of solid lines 401 on the upper surface of the circuit plate 4 and a plurality of dashed lines 401 on the lower surface of the circuit plate 4 in FIG. 11. Therefore, the upper circuits A, B, C, D, E are connected with the lower circuit A', B', C', D', E' totally by the solid lines/the dashed lines 401 and the electrical node 43, and furthermore, the first upper circuit A and the first lower circuit A' are cooperatively connected to the soldering pad 421 by the dashed lines/the solid lines 401 and the electrical node 43.

Figure 1:
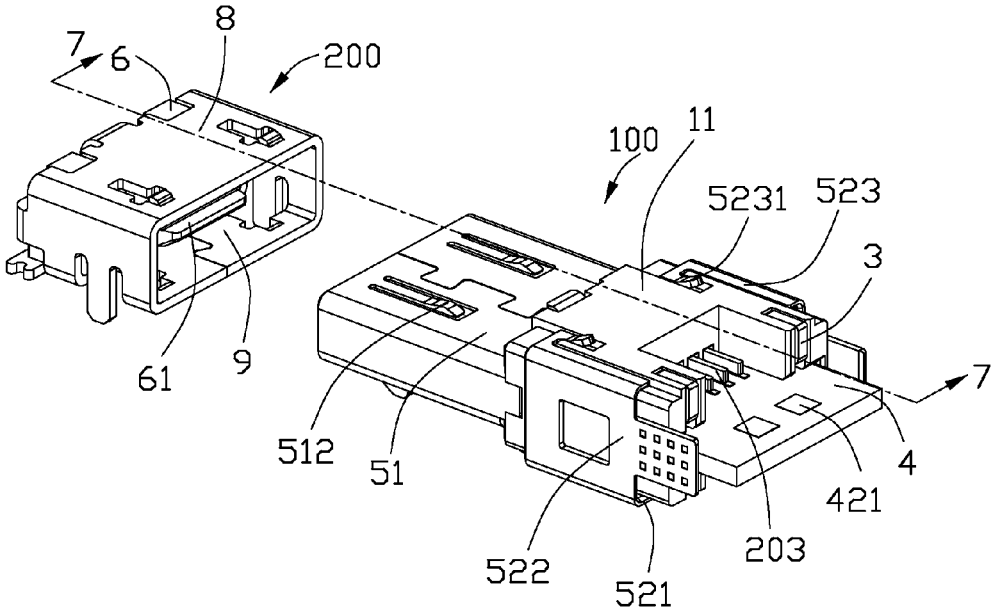
FIG. 1 is a perspective, assembled view of a connector assembly having an Input/Output (I/O) plug connector and an I/O receptacle connector mated with each other constructed in accordance with the present invention.

Referring to FIGS. 1, 2 and 6, the metal shield 5 is stamped from a metal piece. The metal shield 5 comprises a case portion 51 shrouding the mating portion 12 of the insulative housing 1, a frame portion 52 attaching to the base portion 11 of the insulative housing, and a vertical portion 53 connecting between the case portion 51 and the frame portion 52. The case portion 51 defines a pair of slits 511 on an upper face thereof correspondingly exposing the hook portions 33 of the latches 3. The case portion 51 has a pair of spring tabs 512 extending backwardly from a lower face thereof for firmly engaging with a corresponding part (not shown) of the I/O receptacle connector 200. The frame portion 52 comprises a main plate 521, a pair of side plates 522 bending vertically from two opposite edges from the base plate 11, and a pair of bottom plates 523 bending inwardly and vertically from the side plates 522. The main plate 521, the side plates 522, and the bottom plates 523 are respectively and correspondingly attached to a top face, a pair of lateral faces, and a bottom face of the base portion 11 for securing the metal shield 5 on the insulative housing 1. The bottom plates 523 further comprises a pair of flexible tabs 5231 extending backwardly as the spring tabs 512 extend. The flexible tabs 5231 interfere with the insualtive housing 1 to make sure the metal shield 5 is firmly secured on the insulative housing 1. The vertical portion 53 forms a plurality of ribs 531 for improving rigid of the vertical portion 53.

Figure 3:
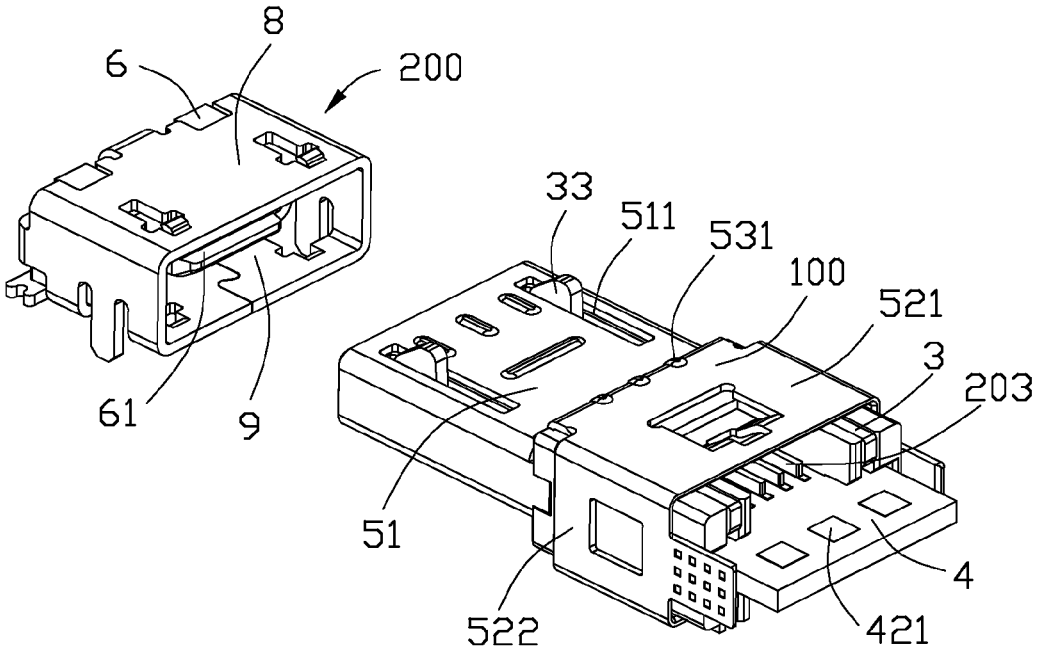
FIG. 3 is another perspective, assembled view of the connector assembly when the I/O plug connector is reversedly inserted into the I/O receptacle connector.
Figure 7:
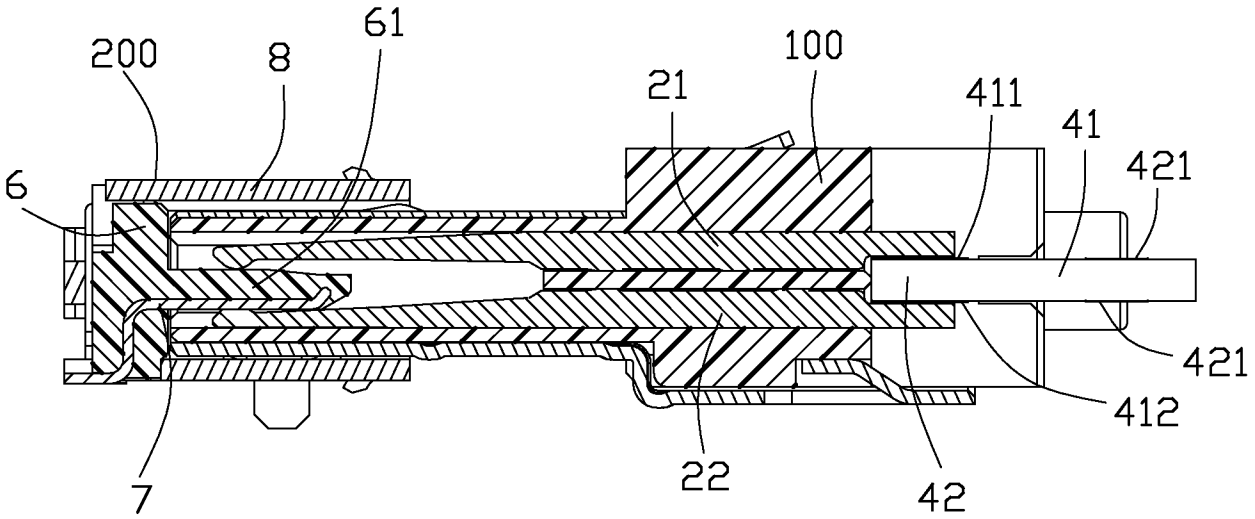
FIG. 7 is a cross-sectional view taken along line 7-7 of FIG. 1.
Figure 8:
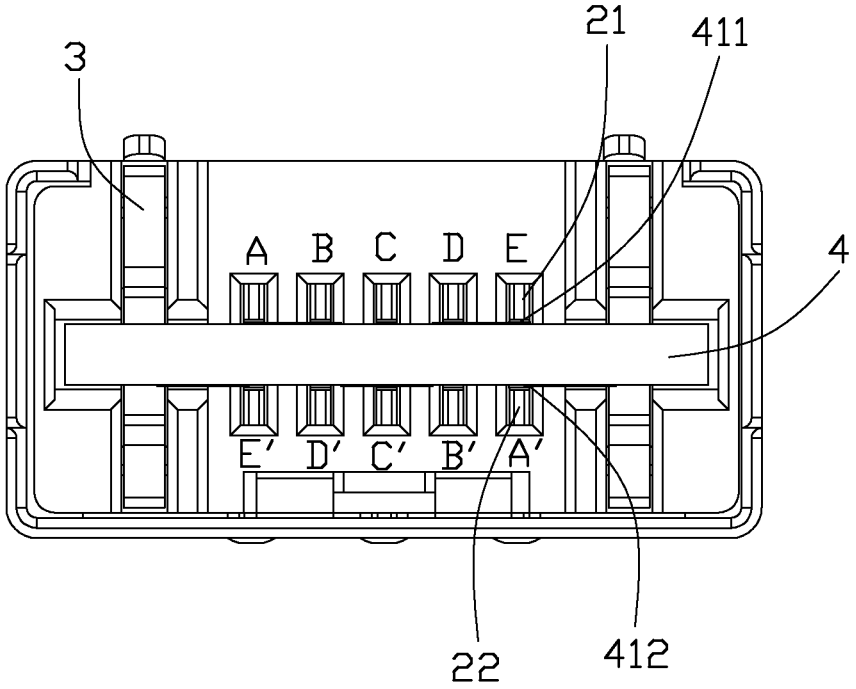
FIG. 8 is a rear elevational view of the I/O plug connector.

Referring to FIGS. 1, 3, and 7, the I/O receptacle connector 200 comprises an insulating body 6, a plurality of terminals 7 retained in the insulating body 6, and a metallic cover 8 shielding the insulating body 6 for defining a receiving room 9. The receiving room 9 is larger than the receiving space 125. The insulating body 6 has a tongue portion 61 and the terminals 7 extend beyond the tongue portion 61 into the receiving room 9. When the I/O plug connector 100 is normally inserted into the I/O receptacle connector 200, the first contacts 21 engage with the terminals 7 for electrical connection. When the I/O plug connector 100 is reversely inserted into the I/O receptacle connector 200, the second contacts 22 engage with the terminals 7 for electrical connection. Both the two conditions when the I/O plug connector 100 is normally and reversely inserted into the I/O receptacle connector 200, the tongue portion 61 and the terminals 7 are accommodated in the receiving space 125 of the I/O plug connector 100 and the mating portion 12, the contacts 2, and the case portion 51 are accommodated in the receiving room 9. Because the tongue portion 61 and the terminals 7 are totally and fully accommodated in the receiving space 125 of the I/O plug connector 100 without any space is idle, the mating portion 12, the contacts 2, and the case portion 51 are totally and fully accommodated in the receiving room 9 without any room is idle, balance engagement is formed between the I/O plug connector 100 and the I/O receptacle connector 200. It prevents damage to electrical connection therebetween and the mating tongue 61 of the I/O receptacle connector 200 induced by possible occurred torsion if tongue portion 61 of the I/O receptacle connector 200 is merely inserted a part of the receiving space 125 of the I/O plug connector 100.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An Input/Output (I/O) plug connector comprising:

an insulative housing having a base portion and a mating portion extending forwardly from the base portion, the mating portion having a top wall, a bottom wall opposite to the top wall, a pair of sidewalls vertically connecting with the top wall and the bottom wall, and a front wall vertically connecting with the top wall, the bottom wall, and the sidewalls, the top wall, the bottom wall, and the sidewalls cooperatively and peripherally defining a receiving space, the receiving space having an insertion opening on the front wall;

a plurality of first contacts retained in the top wall and a plurality of second contacts retained in the bottom wall, the first contacts and the second contacts facing toward each other across the receiving space along a vertical direction;

a circuit plate assembled to the base portion of the insulative housing and sandwiched between the first contacts and the second contacts for electrical connection; and a metal shield covering the insulative housing; wherein the first contacts and the second contacts are paired with each other in a diagonally symmetrical cross manner so as to assure both a normal orientation and a reverse orientation of the I/O plug connector can be mated with an I/O receptacle connector, and the first contact and the second contact in each pair are electrically connected by means of a trace-and-via structure on the circuit plate; wherein the circuit plate comprises a mating tongue connecting with the first and second contacts and an extension portion integral with the mating tongue, and the extension portion has a width larger than that of the mating tongue; wherein the base portion defines a pair of notches and the circuit plate is secured in the notches; wherein the insulative housing defines a pair of slots extending through from the base portion and the mating portion and wherein the I/O plug connector further comprises a pair of latches received in the slots; and wherein the latches defines a pair of cutouts and the latches sandwich the circuit plate firmly in the cutouts.

2. The I/O plug connector as claimed in claim 1, wherein the notches are perpendicular to the slots.

3. The I/O plug connector as claimed in claim 1, wherein the mating tongue has a plurality of upper circuits on an upper surface thereof and a plurality of lower circuits on a lower surface of, the upper circuits are electrically connected with the first contacts, and the lower circuits are electrically connected with the second contacts.

4. A connector assembly comprising:

an Input/Output (I/O) receptacle connector having an insulating body, a plurality of terminals retained in the insulating body, and a metallic cover shielding the insulating body for defining a receiving room; and an I/O plug connector alternatively, normally and reversely inserted in the I/O receptacle connector, and comprising:

an insulative housing having a base portion and a mating portion extending forwardly from the base portion, the mating portion having a top wall, a bottom wall opposite to the top wall, a pair of sidewalls vertically connecting with the top wall and the bottom wall, and a front wall vertically connecting with the top wall, the bottom wall, and the sidewalls, the top wall, the bottom wall, and the sidewalls cooperatively and peripherally defining a receiving space, the receiving space having an insertion opening on the front wall;

a plurality of first contacts retained in the top wall and a plurality of second contacts retained in the bottom wall, the first contacts and the second contacts facing toward each other across the receiving space along a vertical direction;

a circuit plate assembled to the base portion of the insulative housing and sandwiched between the first contacts and the second contacts for electrical connection;

a metal shield covering the insulative housing; wherein the first contacts and the second contacts are paired with each other in a diagonally symmetrical cross manner so as to assure both a normal orientation and a reverse orientation of the I/O plug connector can be mated with said I/O receptacle connector, and the first contact and the second contact in each pair are electrically connected by means of a trace-and-via structure on the circuit plate; wherein the circuit plate comprises a mating tongue connecting with the first and second contacts and an extension portion integral with the mating tongue, and the extension portion has a width larger than that of the mating tongue; wherein the base portion defines a pair of notches and the circuit plate is secured in the notches; wherein the insulative housing defines a pair of slots extending through from the base portion and the mating portion and wherein the I/O plug connector further comprises a pair of latches received in the slots; and wherein the latches defines a pair of cutouts and the latches sandwich the circuit plate firmly in the cutouts.

5. The connector assembly as claimed in claim 4, wherein when the I/O plug connector is normally inserted into the I/O receptacle connector, the first contacts engage with the terminals for electrical connection and when the I/O plug connector is reversely inserted into the I/O receptacle connector, the second contacts engage with the terminals for electrical connection.

6. The connector assembly as claimed in claim 4, wherein the insulating body of the I/O receptacle connector comprises a tongue portion, the metal shield of the I/O plug connector comprises a case portion shrouding the mating portion of the insualtive housing, the tongue portion and the terminals are accommodated in the receiving space of the I/O plug connector, and the mating portion, the contacts, and the case portion are accommodated in the receiving room of the I/O receptacle connector.

7. The connector assembly as claimed in claim 6, wherein the tongue portion and the terminals are totally and fully accommodated in the receiving space of the I/O plug connector without any space is idle.

8. The connector assembly as claimed in claim 6, wherein the mating portion, the contacts, and the case portion are totally and fully accommodated in the receiving room without any room is idle.

9. An electrical connector assembly comprising:

a first connector including:

a first housing having a base portion and a mating portion extending forwardly from the base portion;

a plurality of upper first contacts and a plurality of lower first contacts disposed in the housing and arranged in two rows, each of said first contacts defining a front contacting section and a rear connecting section; and a printed circuit board positioned behind the housing on which the connecting sections of both said upper row and lower row of first contacts are connected; wherein the upper first contacts and the lower first contacts are paired with each other in a diagonally symmetrical cross manner so as to assure both a normal orientation and a reverse orientation of the first connector can be mated with and inserted into a second connector, and the upper first contact and the lower first contact in each pair are electrically connected by means of a trace-and-via structure on the printed circuit board; wherein the printed circuit board comprises a mating tongue connecting with the upper first contacts and the lower first contacts and an extension portion integral with the mating tongue, and the extension portion has a width larger than that of the mating tongue; wherein the base portion defines a pair of notches and the printed circuit board is secured in the notches; wherein the first housing defines a pair of slots extending through from the base portion and the mating portion and wherein the first connector further comprises a pair of latches received in the slots; and wherein the latches defines a pair of cutouts and the latches sandwich the printed circuit board firmly in the cutouts.

10. The electrical connector assembly as claimed in claim 9, wherein each pair is equipped with a solder pad for connecting to a corresponding wire.

11. The electrical connector assembly as claimed in claim 10, wherein vias are located in front of the solder pads.

12. The electrical connector assembly as claimed in claim 9, wherein the connecting sections of the upper first contacts and the connecting sections of the lower first contacts are respectively located on two opposite surfaces of the printed circuit board.

13. The electrical connector assembly as claimed in claim 9, wherein said second connector defining a mating cavity to receive a front portion of the first connector, wherein the second connector defines a mating tongue with corresponding second contacts on one surface thereof to mate with either the upper first contacts or the lower first contacts in response to the respective orientations of the first connector.

14. The electrical connector assembly as claimed in claim 13, wherein a space defines between the contacting sections of the upper first contacts and those of the lower first contacts is close to a thickness of the mating tongue.

15. The electrical connector assembly as claimed in claim 14, wherein said second connector includes means for mounting to another printed circuit board while the first connector is a cable connector having a cable enclosing said wires.

16. The electrical connector assembly as claimed in claim 9, wherein said first connector is equipped with the pair of latches with locking heads around one of said two rows, and the second connector have means for engaging said pair of latches disregarding the orientations of the first connector during mating.

* * * * *